US005434470A

United States Patent [19]

De Wit et al.

[11] Patent Number: 5,434,470

[45] Date of Patent: Jul. 18, 1995

[54] COLOUR DISPLAY TUBE HAVING AN INTERNAL MAGNETIC SHIELD

[75] Inventors: Hendrik J. De Wit; Willem Schouten, both of Eindhoven, Netherlands

[73] Assignee: U.S. Philips Corporation, New York, N.Y.

[21] Appl. No.: 326,148

[22] Filed: Oct. 19, 1994

Related U.S. Application Data

[63] Continuation of Ser. No. 837,515, Feb. 18, 1992, abandoned.

[30] Foreign Application Priority Data

Mar. 8, 1991 [EP] European Pat. Off. ..... 91200505
Oct. 15, 1991 [EP] European Pat. Off. ..... 91202662

[51] Int. Cl.[6] ..... H01J 29/06

[52] U.S. Cl. ..... 313/402; 313/479; 174/35 MS

[58] Field of Search ..... 313/402, 313, 443, 479, 313/326, 356; 174/35 MS; 335/210

[56] References Cited

U.S. PATENT DOCUMENTS 3,867,668 2/1975 Shrader ..... 313/402 X
4,229,675 10/1980 Matsuki et al. ..... 313/402
4,580,076 4/1986 Shimoma et al. ..... 313/402
4,758,193 7/1988 Brown ..... 313/402 X
4,882,516 11/1989 Hirata et al. ..... 313/402 X
5,097,174 3/1992 D'Amato ..... 313/407 X

FOREIGN PATENT DOCUMENTS 0217473 4/1987 European Pat. Off. .
0016575 2/1978 Japan ..... 313/402

*Primary Examiner*—Sandra L. O'Shea
*Assistant Examiner*—Ashok Patel
*Attorney, Agent, or Firm*—Paul R. Miller

[57] ABSTRACT

A color display tube is presented having an elongated display screen with a pattern of phosphor dots. In order to render mislanding errors of the electron beams as small as possible, particularly in the y direction, the color display tube has an internal shield which is provided proximate to its gun-sided open end with a structure for deflecting the field lines of the axial component of the earth's magnetic field more to the short sides than to the long sides of the shield. This structure is particularly constituted in that the short sides are provided with edges extending toward the gun, or in that a border strip has been removed from the long sides.

13 Claims, 6 Drawing Sheets

| POS | Mx (μm) | My (μm) |
|---|---|---|
| N/S | 27 | 0 |
| E/W | 0 | 39 |
| NE/SE NW/SW | 31 | 41 |

FIG. 5a PRIOR ART

| POS | Mx (μm) | My (μm) |
|---|---|---|
| N/S | 6 | 0 |
| E/W | 0 | 16 |
| NE/SE NW/SW | 6 | 18 |

FIG. 5b PRIOR ART

| POS | Mx (μm) | My (μm) |
|---|---|---|
| N/S | 7 | 0 |
| E/W | 0 | 10 |
| NE/SE NW/SW | 10 | 12 |

FIG. 5c PRIOR ART

COLOUR DISPLAY TUBE HAVING AN INTERNAL MAGNETIC SHIELD

This is a continuation of application Ser. No. 07/837,515, filed Feb. 18, 1992 now abandoned.

The invention relates to a colour display tube having an envelope comprising a neck portion, a funnel portion and a window portion;

an electron gun system arranged in the neck portion;

an elongate display screen having a pattern of phosphors on the inner surface of the window portion;

a colour selection means arranged opposite the display screen;

an internal magnetic shield arranged within the funnel-shaped portion, which shield has two long side walls parallel to the long axis of the display screen (the x axis), two short side walls parallel to the short axis of the display screen (the y axis) and a gun-sided open end extending transversely to the longitudinal axis of the display tube.

A colour selection means is herein understood to mean, for example, an apertured shadow mask sheet or a wire mask.

BACKGROUND OF THE INVENTION

In a (colour) display tube the earth's magnetic field deflects the electron paths, which without any measures may cause mislanding of the electrons on a phosphor and discolouration of the picture. Particularly the component of the earth's magnetic field in the direction of the axis of the display tube (commonly referred to as the axial field) plays an important role in this respect, which may become manifest as a lack of colour or even as colour impurity in the comers of the display screen.

A known measure of reducing mislandings due to the earth's magnetic field is the use of an internal magnetic shield. The shape of such a shield roughly follows the contours of the envelope of the display tube. This means that the (funnel-shaped) shield has two long trapezoidal sides which are parallel to the long axis (the x axis) of the display screen and two short trapezoidal sides which are parallel to the short axis (the y axis) of the display screen.

The short sides of the shield often have triangular recesses at the gun side so as to reduce mislanding in the corners due to the axial field. When relatively small tubes and a relatively large pitch of the pixels of the phosphor pattern on the display screen are used, an acceptable result is achieved in this way. When pixels are used on a display screen with a phosphor pattern consisting of (for example, hexagonally arranged) phosphor dots, notably in the case of larger display tubes and/or a smaller pitch of the phosphor pixels, this type of solution does not, however, guarantee a sufficient colour purity.

The invention is based on the recognition that the mislandings in the y direction are larger than those in the x direction because the display screen has a width which is larger than its height. In display tubes in which the phosphors are arranged in accordance with a pattern of vertical rows, the y mislandings are not important. In high-resolution tubes the phosphors are, however, arranged in accordance with a (hexagonal) pattern of dots. Mislandings in the y direction are then as troublesome as those in the x direction. Since by nature the y mislandings are larger due to the aspect ratio of the screen, extra attention is to be paid to this in such tubes.

This applies to an even greater extent to tubes having display screens with a 9:16 aspect ratio, which are more elongate than the conventional display screens having a 3:4 aspect ratio.

SUMMARY OF THE INVENTION

It is an object of the present invention to provide an embodiment of a shield for a (high resolution) colour display tube which sufficiently reduces the detrimental effect of the axial magnetic field on the colour purity in the y direction.

According to the invention a display tube of the type described in the opening paragraph is therefore characterized in that the phosphor pattern is a dot pattern and in that the shield is provided proximate to its open end with means for deflecting the field lines of the axial component of the earth's magnetic field more to the short sides than to the long sides.

The inventive embodiment of the shield in which the field lines of the axial field are deflected towards the east or west side introduces a field component in the x direction which reduces the deflection of the electron paths in the y direction. Consequently, the y mislandings are reduced as compared with a standard shield, be it that this is partly at the expense of a certain enlargement of the x mislandings. Since the y mislandings are largest, the total mislanding due to the axial field can nevertheless be reduced.

A first embodiment is characterized in that the gun-sided open end of the shield has edges at its short side walls only. These edges may be located in the plane of the open end, but for an effective operation it is advantageous when they extend toward the electron gun. The further they extend toward the electron gun, the smaller the y mislanding errors become, but this is partly at the expense of a certain increase of the x mislanding errors. For edge "heights" of more than 50 mm the x mislanding errors become prohibitively large. Within the range of edge heights between 0 and 50 mm it is possible to make the y mislanding errors, as desired, not larger than 15 μm or even not larger than 10 μm. For standard shields it is generally 15 μm or more.

A second embodiment, which is easier to realise, is characterized in that the long side walls of the shield at the gun-sided open end of the shield recede with respect to the short side walls at least proximate to the short side walls, for example, because a border strip has been cut out.

BRIEF DESCRIPTION OF THE DRAWING FIGURES

These and other aspects of the invention will now be described with reference to the accompanying drawings.

FIGS. 5A, 5B and 5C are tabular representations to explain the beam mislandings on the display screen due to the earth's magnetic field;

DESCRIPTION OF THE INVENTION

Figure 1A:
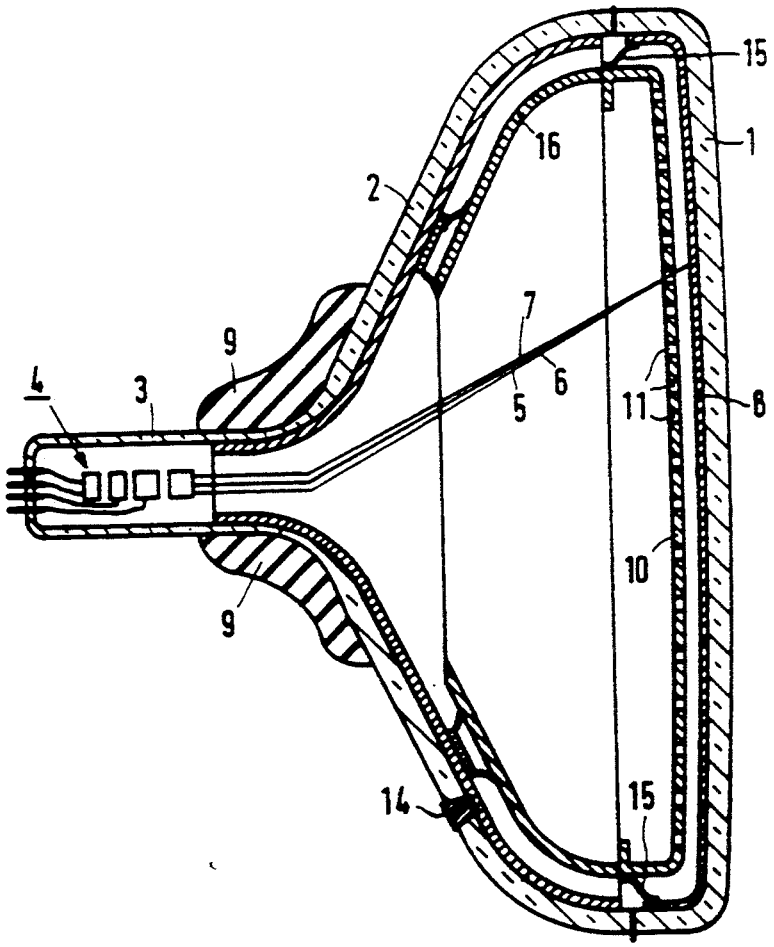
FIG. 1A is a cross-sectional view of a colour display tube.

The display tube shown in a horizontal cross-section in FIG. 1A has a glass envelope comprising a display window 1, a cone 2 and a neck 3. The neck 3 accommodates electrode system 4 with three electron guns for generating three electron beams 5, 6 and 7. The electron beams are generated in one plane (here, the plane of the drawing) and are directed onto a display screen 8 arranged internally on the display window 1 and comprising a large number of red, green and blue- luminescing phosphor dots coated with an aluminium layer. On their way to the display screen 8 the electron beams 5, 6 and 7 are deflected across the display screen 8 by means of a system 9 of deflection coils coaxially surrounding the tube axis and pass a colour selection electrode 10 comprising a metal plate having apertures 11. The three electron beams 5, 6 and 7 pass the apertures 11 at a small angle and consequently only impinge on phosphor dots of one colour. The tube further comprises a high-voltage contact 14 arranged in the tube wall. The colour selection electrode 10 is connected to the display screen 8 by means of a number of contact springs 15. A funnel-shaped magnetic shield 16 is mounted within the glass envelope.

Figure 1B:
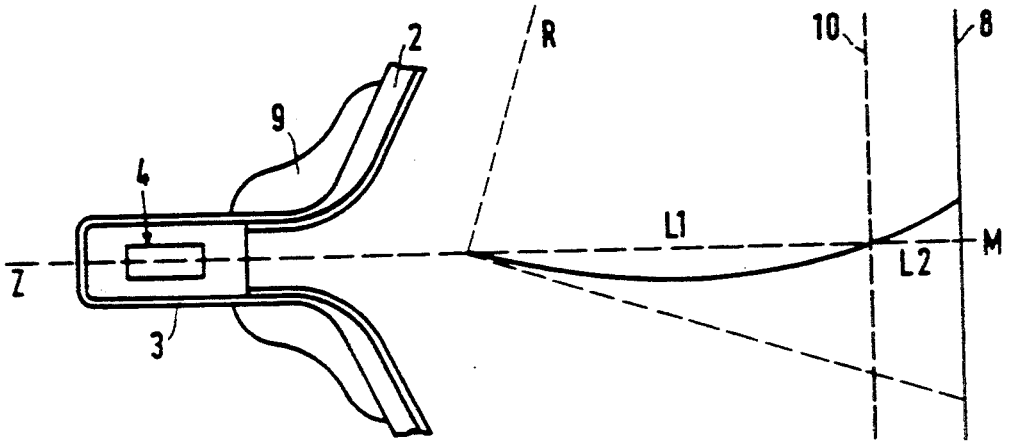
FIG. 1B shows diagrammatically how mislanding is produced.

In a colour display tube electrons pass through apertures of a shadow mask and impinge upon a phosphor. The position of the phosphors is optimal for one tube orientation in one given earth's magnetic field (location on earth). For a different orientation or earth's magnetic field the electron impinges upon another spot on the shadow mask. This causes a distortion of the picture which is particularly detrimental in colour monitors. Moreover, the electron reaches the mask at a different angle. If it passes through an aperture, it is incident with a given mislanding M on the screen under the influence of a field transversely to its direction of movement, see FIG. 1B. If this mislanding is too large, a wrong phosphor may even be reached so that colour errors are produced.

A calculation of the extent of mislanding in the case where the earth's magnetic field is not compensated for at all will be given hereinafter. In a homogeneous field having a magnetic field B the electron describes a path having a radius R which is given by $R=mv_o/eB$, with m, $v_o$ and e denoting mass, velocity and charge, respectively, of the electron. For an earth's magnetic field of $5\times10^{-5}$T ($\sim\frac{1}{2}$ gauss), an electron velocity $v_o$ of $10^8$ m/see and $e/m=1.76\times10^{11}$ C/kg, this yields R=11.4 m. A simple geometrical consideration then yields for the mislanding M:

$$M\approx\frac{L_1\cdot L_2\cdot 2B}{2mv_o}$$

in which $L_1$ is the distance between the electron source and the shadow mask and $L_2$ is the distance between the shadow mask and the screen. It is important to reduce the mislanding as much as possible because this may immediately lead to, for example, a greater luminance of the tube. When increasing the size of the tube, $L_1$ and $L_2$ both increase so that the mislanding becomes quadratically larger.

The direction of the disturbing magnetic field in the tube depends on the location and orientation of the sets. To adapt the magnetization of the shield to the field which is present in a given situation, the shield is demagnetized with a decreasing alternating field whenever the set is switched on.

The shields necessarily have a gun-sided open end. This means that there is no question of overall shielding.

The invention is based on the recognition that the shield must be closed as much as possible and that gaps having high magnetic resistances are to be avoided.

Figure 2:
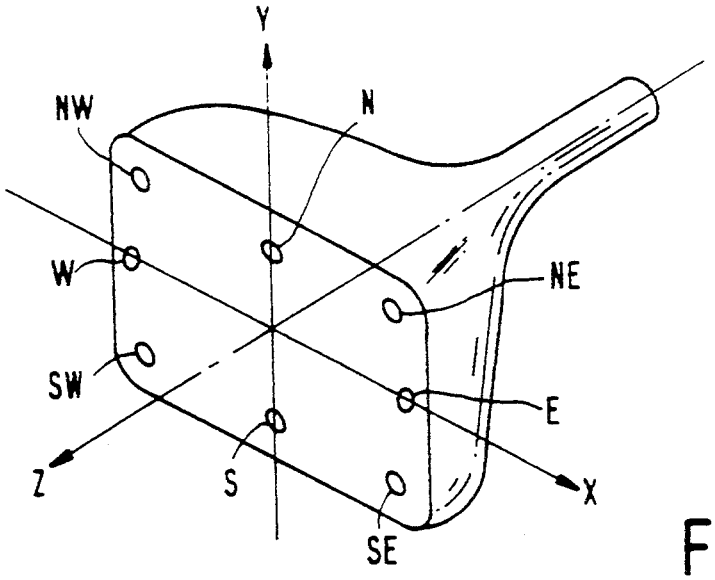
FIG. 2 is a diagrammatic perspective view of a colour display tube with a system of axes and the positions on the display screen where beam mislandings are measured.

To simplify the explanation, FIG. 2 gives a definition of a system of axes in a display tube and of locations on the screen. Here, only the component of the earth's magnetic field in the z direction, the axial field, is considered.

FIGS. 5A, 5B and 5B show calculated values of the electron mislandings at the various locations. It has been assumed that there is an acceleration voltage of 25 kV, a distance of 303 mm between the deflection point and the mask, a distance of 180 mm in the horizontal direction between the center of the screen and the location West, East, etc., a distance of 135 mm between the centers and the locations North, South, etc.; a distance of 10 mm between the mask and the screen, and an axial magnetic field B of $2\times10^{-5}$T. Without shielding, the mislandings are inadmissibly large (see Table FIG. 5A), and it is attempted to make them smaller than 15 μm and particularly smaller than 10 μm. To this end a shield which together with the screen and the mask partly shields the earth's magnetic field is arranged within the tube, see FIGS. 5B and 5C.

Measurements

The fields extending from the deflection point along the electron paths to the different positions on the mask were determined, using 2 different types of shields and the same type of standard shadow mask, diaphragm and suspension for a 51 FS CMT tube. Subsequently the mislandings M were calculated, using the same data as those given in the Table of FIG. 5A. The field between mask and screen was not considered. The results are shown in FIG. 5 in the conventional way. (Mislandings at equivalent positions have been averaged, taking the sign into account.)

Results (the average values of measurements on three or more shields have been given for each type of shield).

Table FIG. 5A: homogeneous field, without shield

Figure 3:
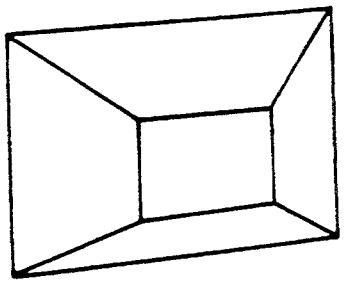
FIG. 3 PRIOR ART
FIG. 3 is a perspective elevational view of an embodiment of a state-of-the-art internal shield.
Figure 4:
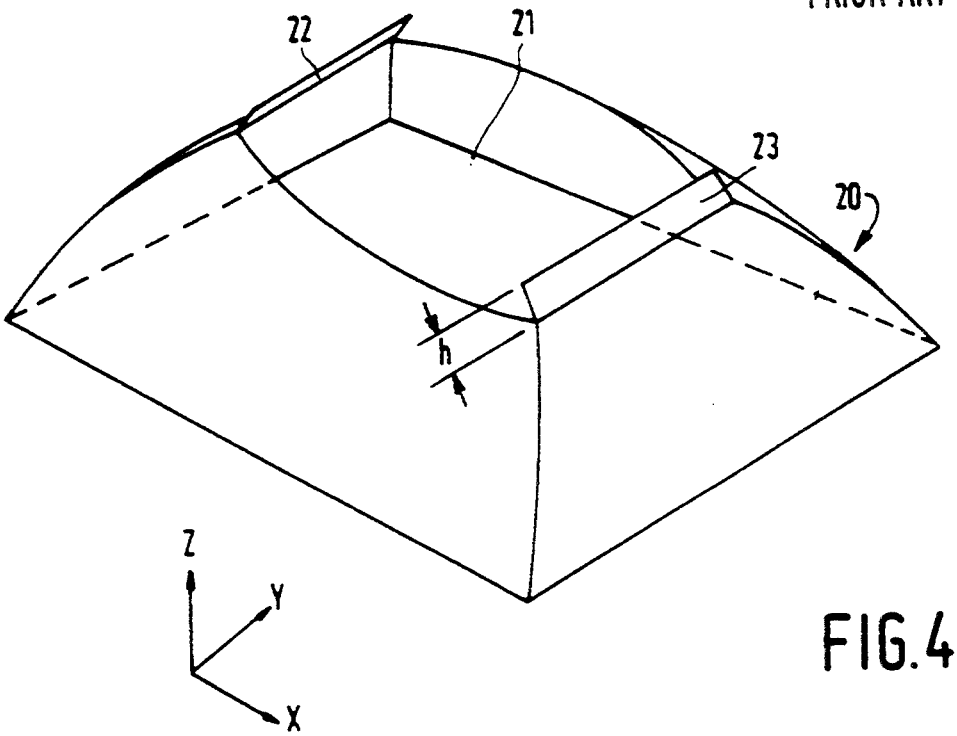
FIG. 4 is a perspective elevational view of a first embodiment of a shield for a display tube according to the invention.

Table FIG. 5B: standard shield for a 51 FS CMT tube (FIG. 3), equally high at all sides Table FIG. 5C: according to the invention (FIG. 4), this shield 20 has edges 22 and 23 with a height h at its open end 21 at each of its short sides.

Shield 20 (FIG. 4) was obtained by means of deep-drawing from a sheet of soft-magnetic material such as steel having a low carbon content, with a thickness of one tenth to several tenths of one min. The values shown in the Table of FIG. 5C are realised with a shield having a height h of 20 mm at the edges 22 and 23. In connection with the stability of the edges 22, 23, a onepiece, deep-drawn shield is more advantageous as compared with a folded and welded shield.

Figure 6:
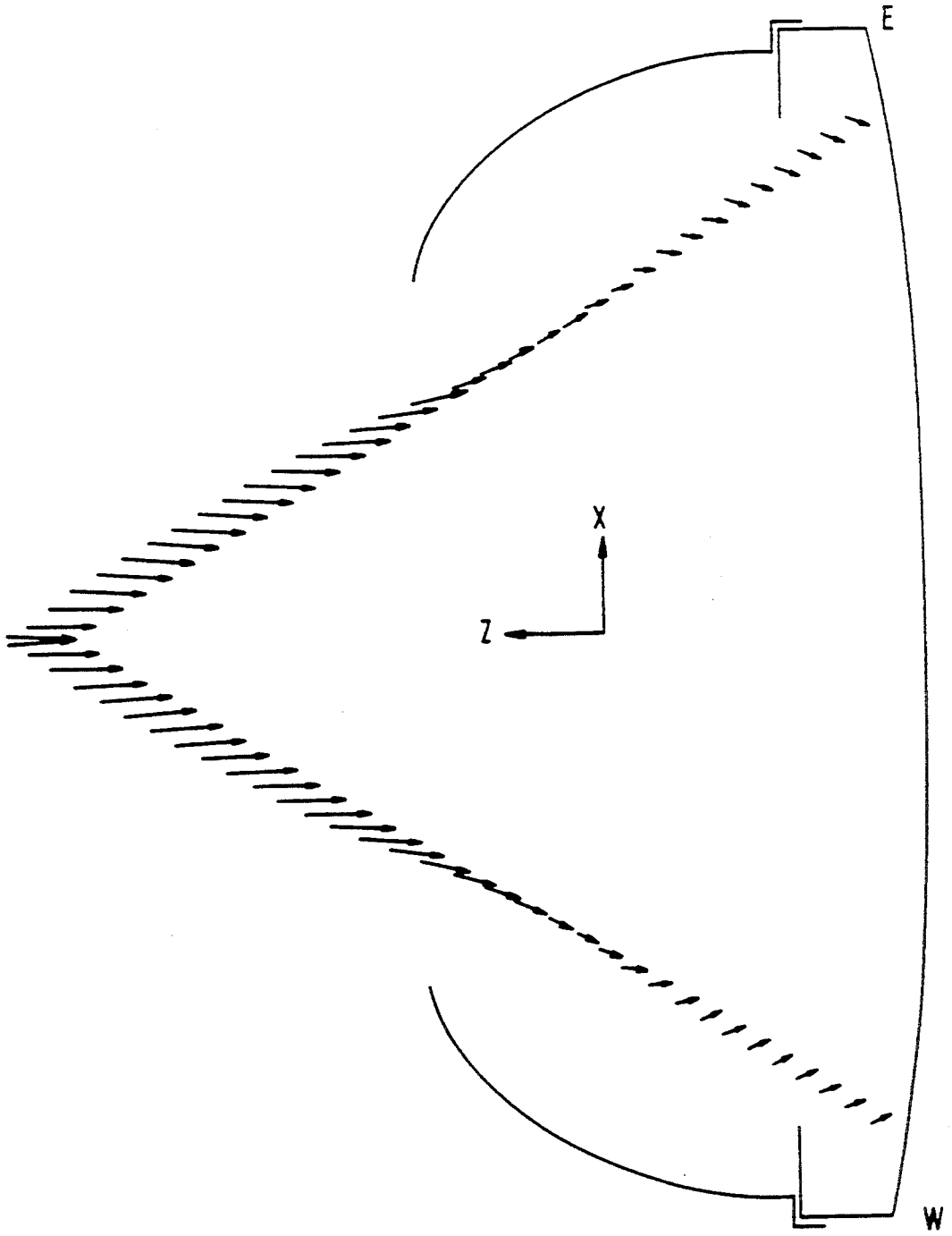
FIG. 6 PRIOR ART
FIG. 6 is a cross-section taken on the x-z plane of a shield of the type of FIG. 3
Figure 7:
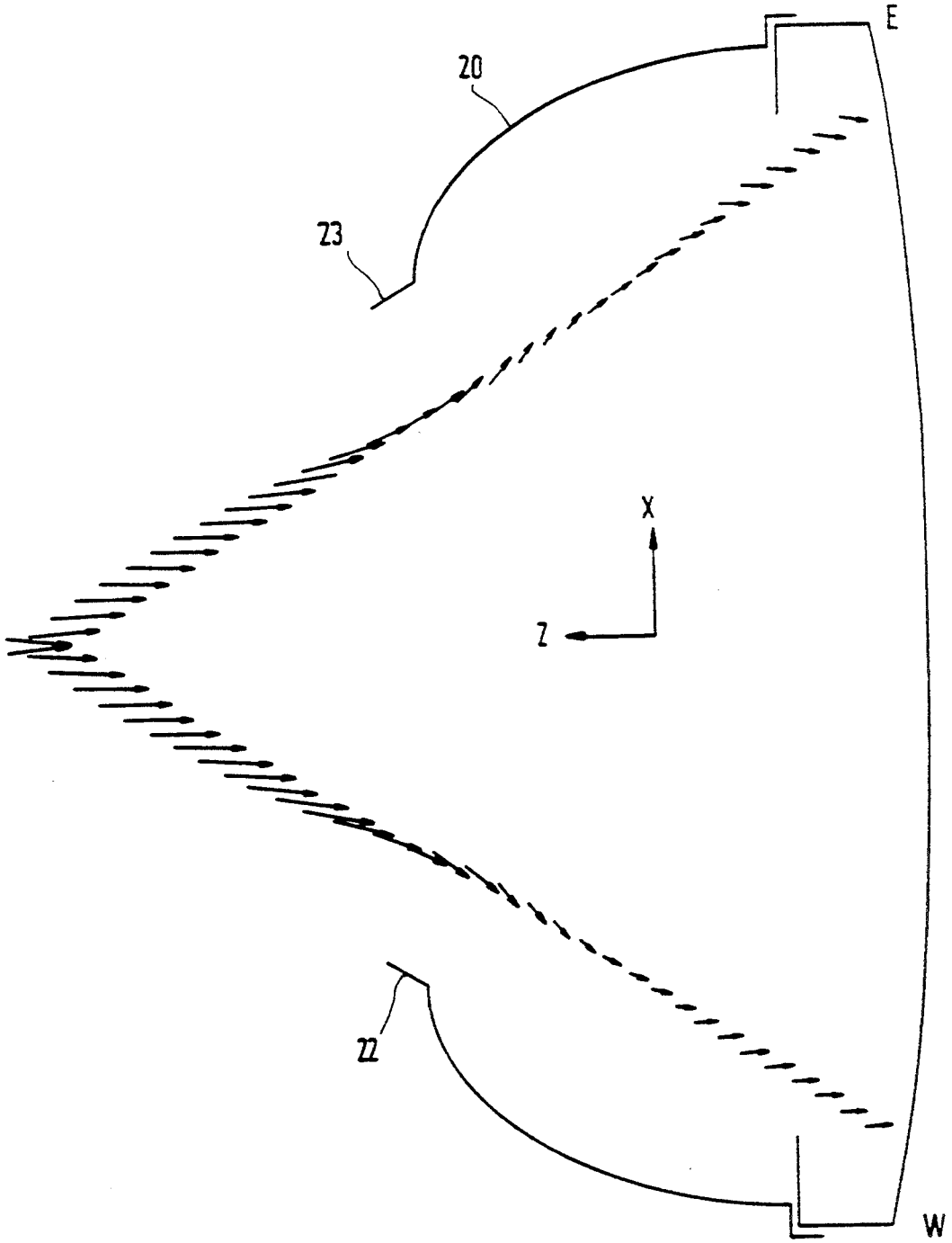
FIG. 7 is a cross-section of one of the types of FIG. 4, an indication of the axial field in positions along the outer electron paths being given for both cases.

The effect of the edges 22, 23 is clarified with reference to FIGS. 6 and 7. These Figures show cross-sections through a standard shield (FIG. 6) and a shield for a display tube according to the invention (FIG. 7). The arrows indicate measured values of the axial field at the positions of the arrow heads along the outer electron paths. The orientation of each arrow is parallel to the local field direction and the length is a measure of the local field strength. In all cases an axial field of 16 A/m is used. FIG. 7 shows that, as compared with FIG. 6, the field turns just within the shield from the axial direction to the east and west sides of the shield, which yields the desired reduction of the mislanding in the x direction Mx.

Figure 8:
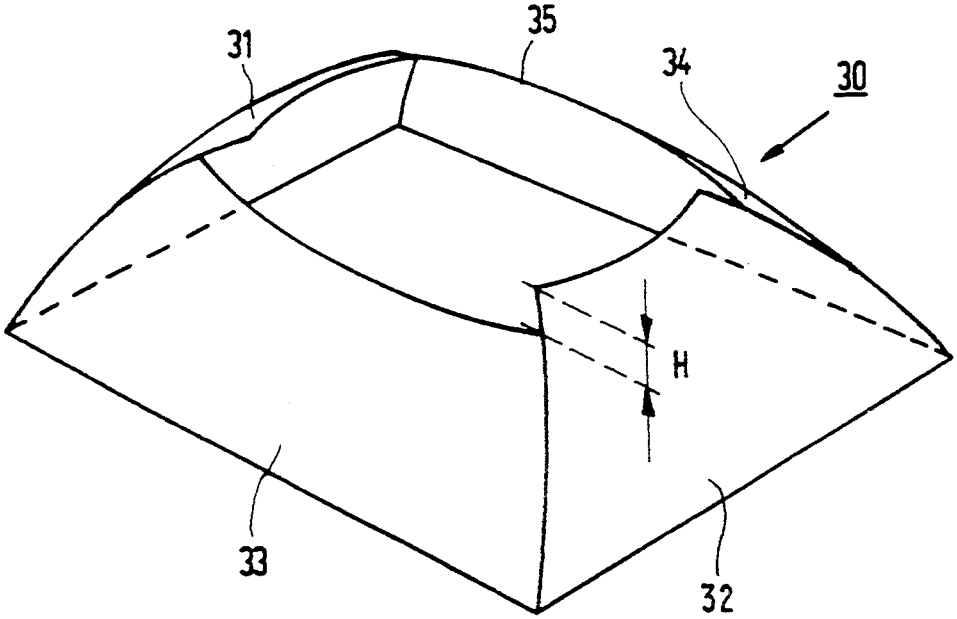
FIG. 8 is a perspective elevational view of a second embodiment of a shield for a display tube according to the invention.

FIG. 8 shows a shield 30 having two short side walls 31, 32 and two long side walls 33, 34. At the narrow (gun-sided) end 35 the long side walls 33, 34 recede with respect to the short side walls 31, 32. To realise this, a border strip may be cut from each long side wall after the shield has been given its shape, thus achieving the effect that the short side walls extend further outwardly across the height in the comer of the cut-out border strip than the long side walls.

A typical value of the height H is approximately 20 mm for display tubes having a 51 cm display screen diagonal. The value of H is dependent on, inter alia, the type of display tube, the dimensions and the material of the shield, and in practice it ranges between several millimeters and several tenths of millimeters.

The long side walls can alternatively be made to recede by punching an aperture having an adapted shape in the sheet from which the shield is to be formed.

We claim:

1. A color display tube comprising (a) an envelope including a neck portion, a funnel-shaped portion and a window portion;

(b) an electron gun system arranged in said neck portion;

(c) an elongated display screen having a pattern of phosphors on the inner surface of said window portion, said pattern of phosphors being a dot pattern;

(d) color selection means arranged within said envelope opposite to said display screen;

(e) an internal magnetic shield arranged within said funnel-shaped portion, said shield having a structure of two long side walls parallel to the long axis of said display screen, two short side walls parallel to the short axis of said display screen, and an open end facing said electron gun portion and extending transversely to a longitudinal axis of said display tube, all of said side walls being free of slots and slot structures; and (f) deflecting means on said internal magnetic shield for deflecting magnetic field lines of axial components of the earth's magnetic field more to said short side walls than to said long side walls, said deflecting means including said two short side walls having extended edges, said extended edges extending outwardly away from surfaces of all of said side walls.

2. A color display tube according to claim 1, wherein said extend edges only from edges of said two short side walls at said open end.

3. A color display tube according to claim 2, wherein said extended edges extend toward said electron gun system.

4. A color display tube according to claim 3, wherein said extended edges extend for a distance of at most 50 mm.

5. A color display tube according to claim 2, wherein said extended edges extend for a distance of at most 50 mm.

6. A color display tube according to claim 2, wherein said elongated display screen has an aspect ratio of 9:16.

7. A color display tube according to claim 1, wherein said deflection means includes recessed portions of said two long side walls at said open end, said recessed portions extending approximate to said short side walls.

8. A color display tube comprising (a) an envelope including a neck portion, a funnel-shaped portion and a window portion;

(b) an electron gun system arranged in said neck portion;

(c) an elongated display screen having a pattern of phosphors on the inner surface of said window portion, said pattern of phosphors being a dot pattern;

(d) color selection means arranged within said envelope opposite to said display screen;

(e) an internal magnetic shield arranged within said funnel-shaped portion, said shield having a structure of two long side walls parallel to the long axis of said display screen, two short side walls parallel to the short axis of said display screen, and an open end facing said electron gun portion and extending transversely to a longitudinal axis of said display tube; and (f) deflecting means on said internal magnetic shield for deflecting magnetic field lines of axial components of the earth's magnetic field more to said short side walls than to said long side walls, said deflecting means being disposed approximate to said open end, wherein said deflecting means includes extended edges extending outwardly away from all of said side walls and only from edges of said two short side walls at said open end.

9. A color display tube according to claim 8, wherein said extended edges extend toward said electron gun system.

10. A color display tube according to claim 9, wherein said extended edges extend for a distance of at most 50 nm.

11. A color display tube according to claim 8, wherein said extended edges extend for a distance of at most 50 mm.

12. A color display tube according to claim 8, wherein said elongated display screen has an aspect ratio of 9:16.

13. A color display tube according to claim 8, wherein said deflection means includes recessed portions of said two long side walls at said open end, said recessed portions extending approximate to said short side walls.

* * * * *